US011149679B2

(12) United States Patent
Chen et al.

(10) Patent No.: US 11,149,679 B2
(45) Date of Patent: Oct. 19, 2021

(54) INTERNAL COMBUSTION ENGINE WITH TOP-DOWN COOLING

(71) Applicant: Caterpillar Inc., Peoria, IL (US)

(72) Inventors: Allen Yao Chen, Dunlap, IL (US); Aaron Gary Heintz, Washington, IL (US); Jason Lee Van Farowe, Brimfield, IL (US); Thomas L. Atwell, Peoria, IL (US); David L. Lueders, Henry, IL (US); John W. Milem, Brimfield, IL (US); Phani Chandar Reddy Konatham, Peoria, IL (US); Suresh Babu Chennagowni, Peoria, IL (US); Khairul Hassan, Peoria, IL (US); Parthipan Subramanian, Chennai (IN)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/790,824

(22) Filed: Feb. 14, 2020

(65) Prior Publication Data

US 2021/0254577 A1 Aug. 19, 2021

(51) Int. Cl.

| | |
|---|---|
| ***F01L 9/00*** | (2021.01) |
| ***F02F 1/16*** | (2006.01) |
| ***F02F 1/40*** | (2006.01) |
| ***F01P 5/10*** | (2006.01) |

(52) U.S. Cl.
CPC ..... *F02F 1/16* (2013.01); *F01P 5/10* (2013.01); *F02F 1/40* (2013.01)

(58) Field of Classification Search
CPC ..... F01P 1/06; F01P 3/12; F01P 3/00; F01P 3/04; F01P 3/10; F01P 5/10
USPC ..... 123/41.01, 41.17, 41.24, 41.35, 41.44
See application file for complete search history.

(56) References Cited

U.S. PATENT DOCUMENTS

| | | | | |
|---|---|---|---|---|
| 5,715,776 | A * | 2/1998 | Seidl | F01P 5/10 123/41.1 |
| 5,937,802 | A * | 8/1999 | Bethel | F01P 3/02 123/41.08 |
| 6,481,392 | B1 | 11/2002 | Sassan | |
| 7,225,766 | B2 | 6/2007 | Zahdeh | |
| 8,402,930 | B1 * | 3/2013 | Taylor | F01P 3/202 123/41.29 |

(Continued)

FOREIGN PATENT DOCUMENTS

| | | |
|---|---|---|
| CN | 202746025 U | 2/2013 |
| EP | 0232467 | 8/1987 |

(Continued)

*Primary Examiner* — John Kwon
(74) *Attorney, Agent, or Firm* — Bookoff McAndrews

(57) ABSTRACT

An internal combustion engine having an engine block and one or more cylinder heads. The engine block houses a plurality of cylinder liners and includes a cylinder liner coolant jacket below an upper planar surface of the engine block and in fluid communication with the plurality of cylinder liners. The one or more cylinder heads are attached to the upper planar surface of the engine block and each of the one or more cylinder heads including one or more cylinder head coolant jackets and one or more downward coolant passages extending from the one or more cylinder head coolant jackets to the cylinder liner coolant jacket for delivering coolant from the one or more cylinder head coolant jackets to the cylinder liner coolant jacket.

20 Claims, 5 Drawing Sheets

(56) References Cited

U.S. PATENT DOCUMENTS

| | | | | |
|---|---|---|---|---|
| 8,479,691 | B1 * | 7/2013 | Taylor | F01P 3/202 123/41.29 |
| 8,539,916 | B2 | 9/2013 | Hamakawa et al. | |
| 10,464,125 | B1 * | 11/2019 | Kollock | F02F 1/36 |
| 2006/0157002 | A1 * | 7/2006 | Pfeffinger | F01P 7/165 123/41.29 |
| 2009/0320472 | A1 * | 12/2009 | Cowland | F01M 11/02 60/624 |
| 2012/0031354 | A1 * | 2/2012 | Beyer | F02F 1/243 123/41.79 |
| 2012/0204821 | A1 * | 8/2012 | Tofukuji | F02F 1/14 123/41.79 |
| 2012/0245830 | A1 * | 9/2012 | Eser | G01K 15/007 701/113 |
| 2013/0055971 | A1 * | 3/2013 | Brewer | F02F 1/36 123/41.82 R |
| 2015/0159540 | A1 | 6/2015 | Misumi et al. | |
| 2017/0044967 | A1 * | 2/2017 | Maki | F02F 7/0007 |
| 2019/0093542 | A1 | 3/2019 | Palmisani et al. | |

FOREIGN PATENT DOCUMENTS

| | | | |
|---|---|---|---|
| EP | 1930564 | A1 | 6/2008 |
| EP | 3219971 | | 9/2017 |
| EP | 3379063 | | 9/2018 |
| JP | 4395002 | B2 | 1/2010 |
| JP | 2019044744 | A | 3/2019 |

* cited by examiner

INTERNAL COMBUSTION ENGINE WITH TOP-DOWN COOLING

TECHNICAL FIELD

This disclosure relates generally to an internal combustion engine and, more specifically, to an internal combustion engine having top-down cooling.

BACKGROUND

Internal combustion engines are typically liquid-cooled. A conventional coolant system for an internal combustion engine may include a coolant pump that pumps coolant into a coolant jacket of a engine block of the engine. The coolant then flows longitudinally through a portion of the coolant jacket surrounding the cylinders of the engine. The cylinders are cooled by the passing coolant through contact with the cylinder walls. The coolant then flows upward into a water jacket of one or more cylinder heads to cool the components of the cylinder heads, such as injectors and valves, and then exits the engine. The coolant system may also include a number of other components, such as for example, a radiator, a thermostat, an EGR cooler, an aftercooler, and an oil cooler.

A conventional coolant flow path through an engine, as described above, may result in uneven cooling of the cylinders due to increasing temperatures as the coolant flows longitudinally along the cylinders and uneven coolant flow across the cylinders. U.S. Pat. No. 7,225,766 ("the '766 patent") issued to Zandeh on Jun. 5, 2007 discloses a coolant jacket design for an engine in which coolant is delivered by inlet galleries to the upper ends of the cylinders, adjacent the combustion chambers. The coolant is distributed equally to side flow slots along the cylinders and flows axially downward along the cylinders to the cooler lower ends where it is collected in outlet galleries and discharged from the coolant jacket.

SUMMARY

In accordance with one aspect of the present disclosure, An internal combustion engine having an engine block and one or more cylinder heads. The engine block houses a plurality of cylinder liners and includes a cylinder liner coolant jacket below an upper planar surface of the engine block and in fluid communication with the plurality of cylinder liners. The one or more cylinder heads are attached to the upper planar surface of the engine block and each of the one or more cylinder heads including one or more cylinder head coolant jackets and one or more downward coolant passages extending from the one or more cylinder head coolant jackets to the cylinder liner coolant jacket for delivering coolant from the one or more cylinder head coolant jackets to the cylinder liner coolant jacket.

In accordance with another aspect of the present disclosure, a method of cooling an internal combustion engine that includes an engine block and one or more cylinder heads attached to an upper planar surface of an engine block. The method includes pumping coolant into the one or more cylinder heads and directing coolant downward from the one or more cylinder heads into the engine block adjacent one more of a plurality of cylinder liners housed in the engine block to cool the cylinder liners.

In accordance with another aspect of the present disclosure, an engine block, includes an upper planar surface, a plurality of in-line cylinders extending downward from the upper planar surface into the engine block, a cylinder coolant jacket below the upper planar surface and surrounding the plurality of cylinders, a coolant cavity below the cylinder coolant jacket, a plurality of upward coolant passages extending from the coolant cavity through the upper planar surface and bypassing the cylinder coolant jacket, and a plurality of downward coolant passages extending from the upper planar surface into the cylinder coolant jacket to supply coolant to the cylinder coolant jacket.

BRIEF DESCRIPTION OF THE DRAWINGS

Further features and advantages will be evident from the following illustrative embodiment which will now be described, purely by way of example and without limitation to the scope of the claims, and with reference to the accompanying drawings, in which:

DETAILED DESCRIPTION

While the present disclosure describes certain embodiments of an internal combustion engine with internal coolant passages, the present disclosure is to be considered exemplary and is not intended to be limited to the disclosed embodiments. Also, certain elements or features of embodiments disclosed herein are not limited to a particular embodiment, but instead apply to all embodiments of the present disclosure.

Figure 1:
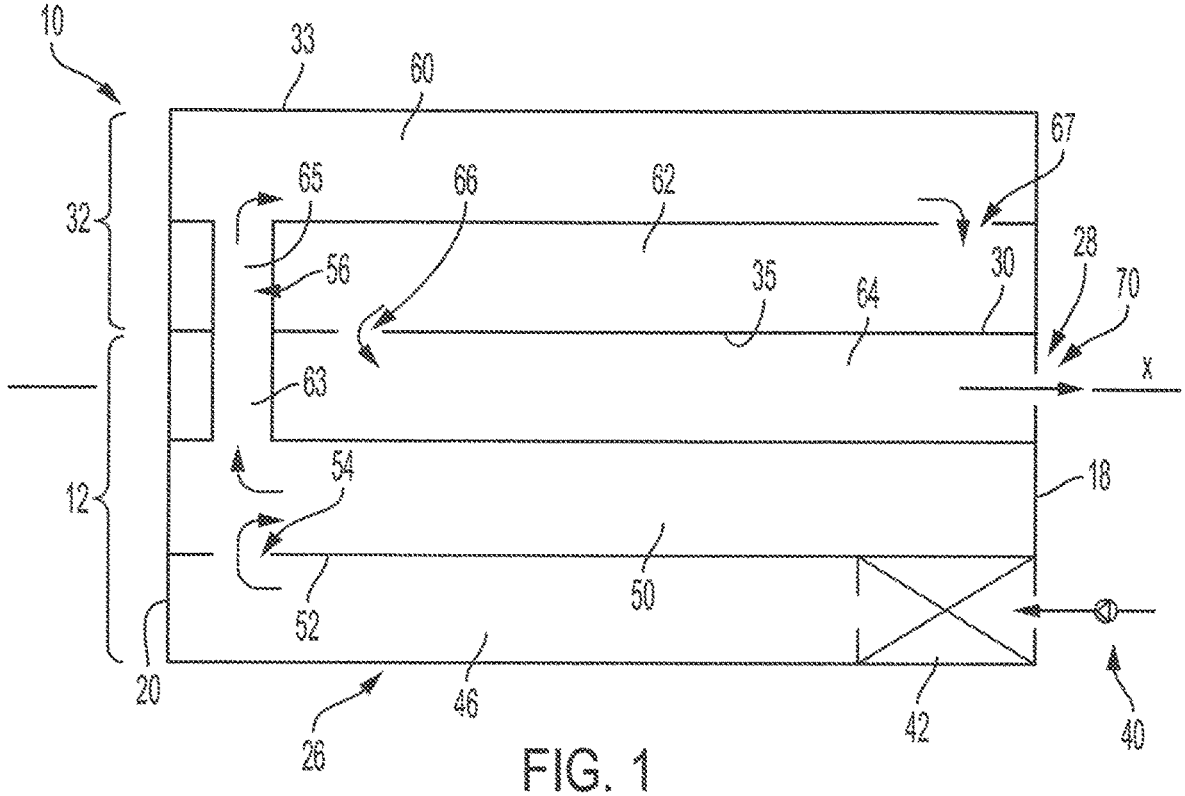
FIG. 1 is a schematic illustration of a side view of an exemplary embodiment of an engine with internal coolant passages.
Figure 2:
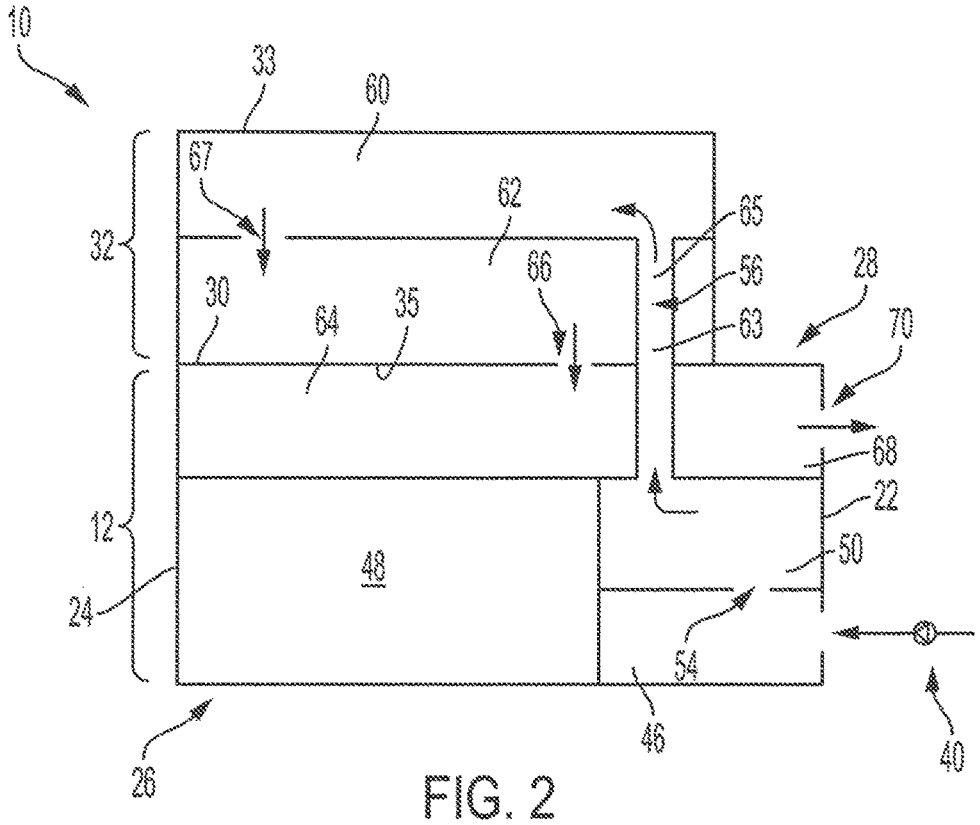
FIG. 2 is a schematic illustration of an end view of the engine of FIG. 1.
Figure 3:
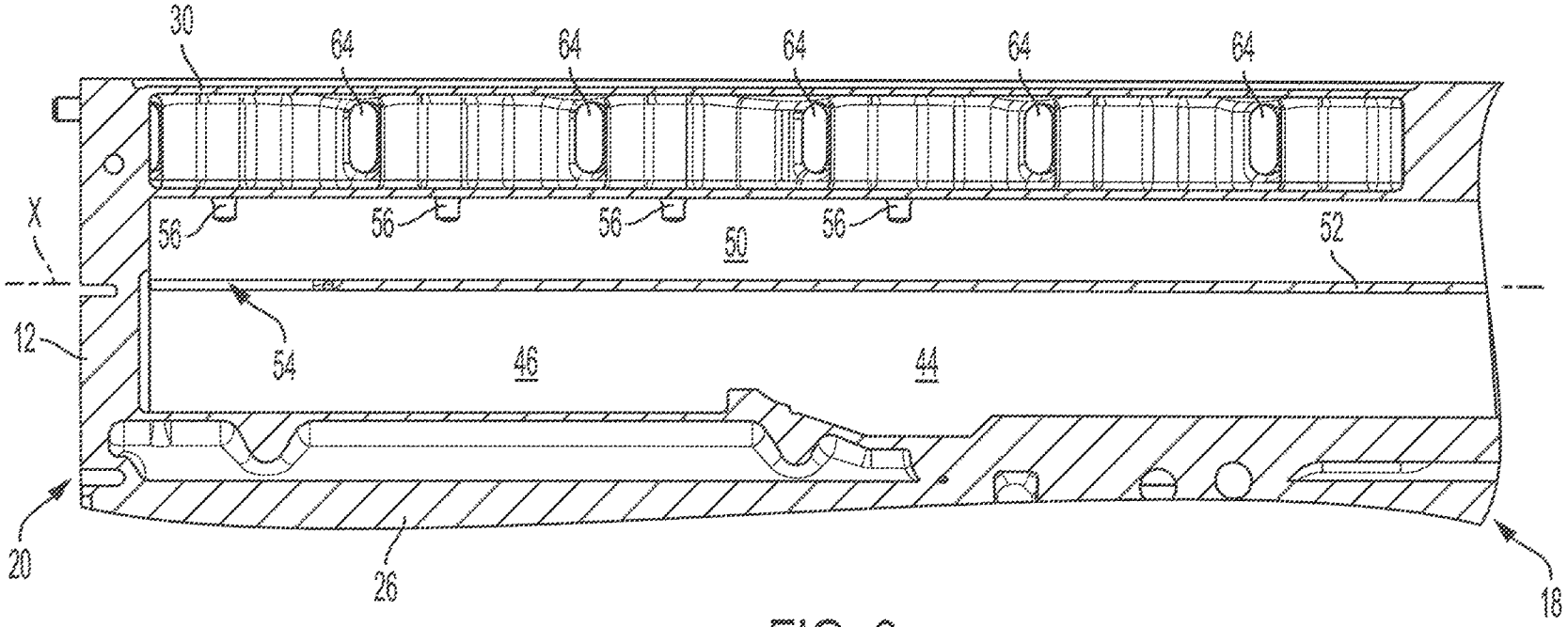
FIG. 3 is a partial side section view of an entry coolant rail and inlet coolant rail of the engine of FIG. 1.

Referring to FIGS. 1-2, an exemplary embodiment of an internal combustion engine 10, such as a diesel engine, is shown. The engine 10 may provide power to various types of applications and/or machines. For example, the engine 10 may power a machine such as an off-highway truck, a railway locomotive, an earth-moving machine, such as a wheel loader, excavator, dump truck, backhoe, motor grader, material handler, or the like. The term "machine" can also refer to stationary equipment like a generator that is driven by the engine 10 to generate electricity.

Figure 6:
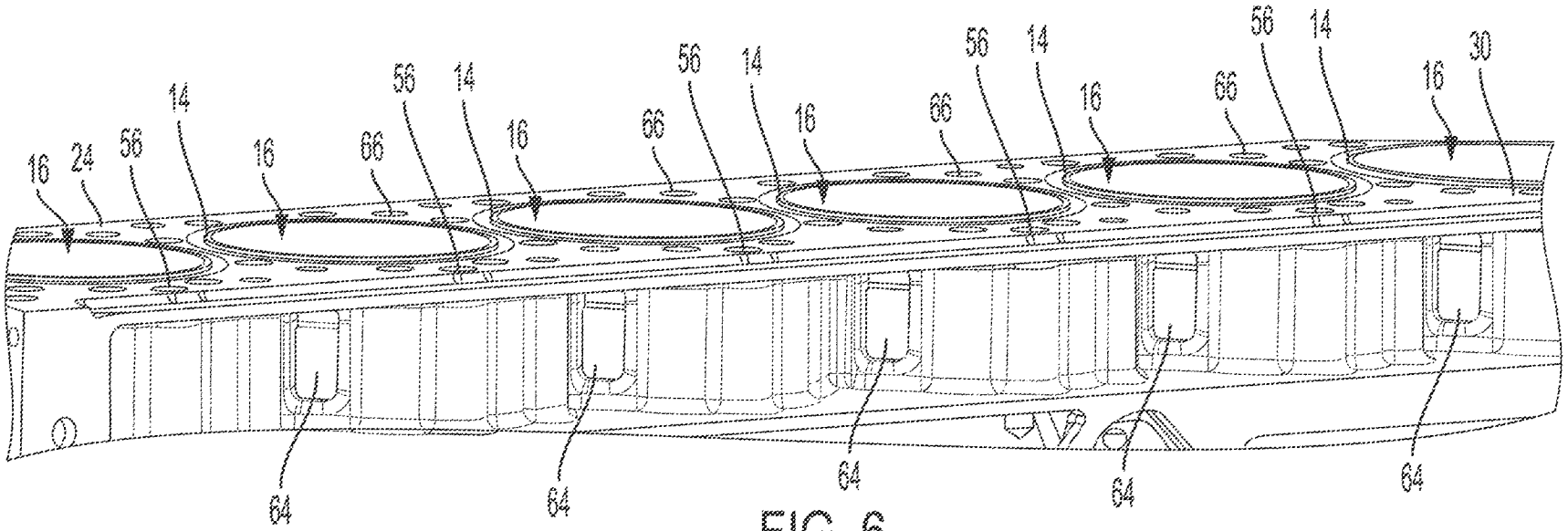
FIG. 6 is a partial perspective view of an upper coolant jacket and lower coolant jacket of the engine of FIG. 1.

The engine 10 includes an engine block 12 that houses one or more cylinder liners 14 defining one or more corresponding cylinders 16 (see FIG. 6). Each of the cylinders 16 may be configured to slidably receive a piston (not shown) therein. In the illustrated embodiment, the engine 10 is an in-line type and includes six cylinders 16. In other embodiments, however, the engine 10 may include more or less than six cylinders 16 and may be a V-type, a rotary type, or other types known in the art.

The engine block 12 extends along a longitudinal axis X and includes a first end 18, a second end 20 opposite the first end 18, a first side 22 extending between the first end 18 and the second end 20, and a second side 24 opposite the first side 22 and extending between the first end 18 and the second end 20. The engine block 12 further includes a lower portion 26 and an upper portion 28 opposite the lower portion 26. The upper portion 28 defines a planar upper surface or deck 30.

Figure 4:
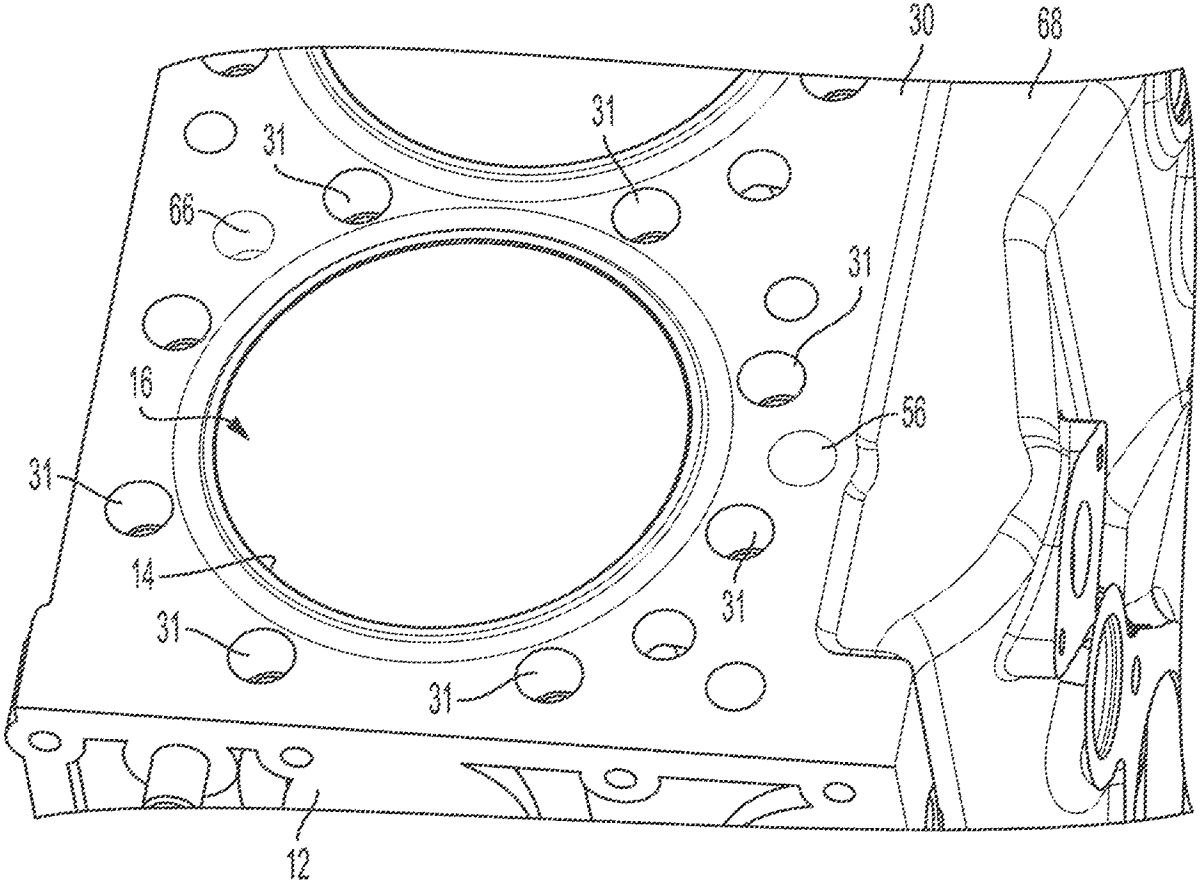
FIG. 4 is a partial top view of the deck surface of the engine of FIG. 1.
Figure 5:
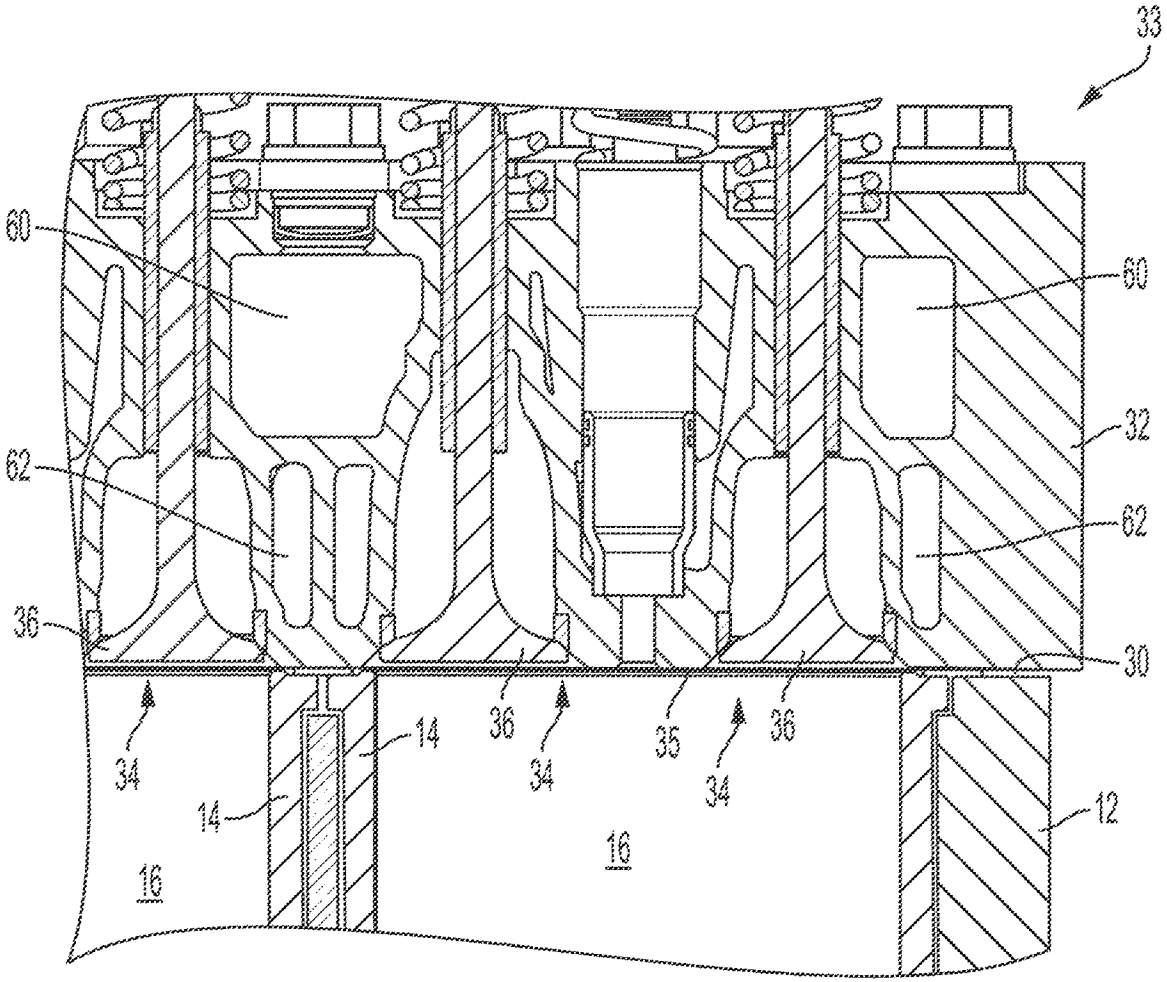
FIG. 5 is a partial side section view of an upper coolant jacket and a lower coolant jacket of the engine of FIG. 1.

As shown in FIG. 5, one or more cylinder heads 32 are attached to the deck 30. The one or more cylinder heads 32 include a top end 33 and a bottom end 35. The bottom end 35 of each of the one or more cylinder heads 32 faces the deck 30, typically with a gasket (not shown) therebetween, when the one or more cylinder heads 32 are attached to the engine block 12. For attaching the one or more cylinder heads 32 to the engine block 12, the deck 30 may include a plurality of bolt holes 31 (FIG. 4) used to bolt the one or more cylinder heads 32 to the deck 30. The one or more cylinder heads 32 include a plurality of ports 34 with a valve 36 associated with each of the ports 34. The valves 36 are configured to regulate fluid communication into and out of the one or more cylinders 16 via the ports 34.

The engine 10 is liquid cooled and includes a plurality of passages in the engine block 12 and the one or more cylinder heads 32 for coolant to flow through to cool the engine 10. The engine 10 includes a coolant pump 40 for pumping coolant through the engine 10. Any suitable coolant pump 40 capable of providing the required coolant flow through the engine 10 may be used.

The engine 10 may include an oil cooler 42 (FIG. 1) that receives coolant from the coolant pump 40 in order to cool the oil in the engine 10. Any suitable oil cooler 42 may be used, such as for example, a shell and tube or plate style heat exchanger. In the illustrated embodiment, the engine block 12 includes an oil cooler cavity 44 configured to house the oil cooler 42. In the illustrated embodiment, the oil cooler cavity 44 is in or near the lower portion 26 of the engine block 12 and adjacent the first end 18 of the engine block 12.

The engine 10 includes a first coolant cavity 46, referred to as the entry coolant rail, adjacent and in fluid communication with the oil cooler cavity 44. The first coolant cavity 46 may be configured in any suitable manner, such as a variety of shapes, sizes, and locations in the engine block 12. In illustrated embodiment, the first coolant cavity 46 extends parallel to the longitudinal axis X from the oil cooler cavity 44 to a position adjacent or near the second end 20 of the engine block 12. As shown in FIG. 2, the first coolant cavity 46 extends along the first side 22 of the engine block 12 adjacent a crankcase 48 of the engine 10.

The engine 10 includes a second coolant cavity 50, referred to as the inlet coolant rail, in fluid communication with the first coolant cavity 46. The second coolant cavity 50 may be configured in any suitable manner, such as a variety of shapes, sizes, and locations in the engine block 12. In the illustrated embodiment, the second coolant cavity 50 extends parallel to and above the first coolant cavity 46 and may extend from the first end 18 to the second end 20 of the engine block 12. The second coolant cavity 50 is separated from the first coolant cavity 46 by a longitudinally extending first wall 52. One or more first coolant passages 54 place the second coolant cavity 50 in fluid communication with the first coolant cavity 46. In the illustrated embodiment, the first wall 52 is absent at or near the second end 20 of the engine block 12 such that the first coolant cavity 46 is open to the second coolant cavity 50 to form the first coolant passage 54. The one or more first coolant passages 54, however, may be formed in any suitable manner to place the place the second coolant cavity 50 in fluid communication with the first coolant cavity 46. As shown in FIG. 2, the second coolant cavity 50 extends along the first side 22 of the engine block 12 adjacent a crankcase 48 of the engine 10.

The engine 10 includes one or more second coolant passages 56 extending from the second coolant cavity 50 to the one or more cylinder heads 32. The one or more second coolant passages 56 are upward coolant flow passages since the one or more second coolant passages 56 are configured to allow coolant to flow upward from the second coolant cavity 50 to the one or more cylinder heads 32. The one or more second coolant passages 56 are sized and arranged such that coolant pools in the second coolant cavity Each of the one or more cylinder heads 32 includes a third coolant cavity 60 referred to as the upper coolant jacket and a fourth coolant cavity 62 referred to as the lower coolant jacket. The third coolant cavity 60 and the fourth coolant cavity 62 of each of the one or more cylinder heads 32 may be configured in any suitable manner, such as a variety of shapes, sizes, and locations in the one or more cylinder heads 32. The one or more second coolant passages 56 extend from the second coolant cavity 50 to the third coolant cavity 60 of each of the one or more cylinder heads 32. Thus, each of the one or more second coolant passages 56 includes a first portion 63 of the coolant passage in the engine block 12 and a second portion 65 of the coolant passage in one of the one or more cylinder heads 32. The first portion 63 and the second portion 65 of each of the second coolant passages 56 are aligned to allow flow from the first portion 63 into the second portion 65 when each of the cylinder heads 32 are assembled to the engine block 12.

In FIG. 1, for simplicity, a single second coolant passage 56 is illustrated. The one or more second coolant passages 56, however, may be configured in any suitable manner, such as a variety of shapes, sizes, number of passages, and locations of the passages in the engine block 12 and the one or more cylinder heads 32. In some embodiments, a second coolant passage 56 is associated with each of the cylinders 16. Thus, as shown in FIG. 6, for example, for an engine 10 having six cylinders 16, there are six second coolant passages 56 for directing coolant from the second coolant cavity 50 to the third coolant cavity 60. As shown in FIGS. 4 and 6, in the illustrated embodiment, one of the plurality of second coolant passages 56 extends through the deck 30 at a location adjacent each of the cylinders 16 and between each of the cylinders 16 and the first side 22 of the engine block 12, such that the plurality of second coolant passages 56 are evenly spaced along a length of the engine block 12 and aligned with each cylinder 16.

In the illustrated embodiment, the size and arrangement of the plurality of second coolant passages 56 relative to the second coolant cavity 50 and the relatively larger size and arrangement of the second coolant cavity 50 acts to create a pool of coolant in the second coolant cavity 50 along the engine block 12. The pool of coolant, which in the illustrated embodiment extends from the first end 18 to the second end 20 of the engine block 12, supplies coolant to the spaced apart plurality of second coolant passages 56 evenly to provide an even flow of coolant into the third coolant cavity 60.

The third coolant cavity 60 in each of the one or more cylinder heads 32 is adjacent the top end 33 of each of the cylinder heads 32. The third coolant cavity 60 is in fluid communication with the second coolant cavity 50 via the plurality of second coolant passages 56. The third coolant cavity 60 in each of the one or more cylinder heads 32 is configured to cool cylinder head components near the top end 33 and middle each of the cylinder heads 32.

The fourth coolant cavity 62 is in fluid communication with the third coolant cavity 60 and configured to receive coolant from the third coolant cavity 60 via one or more third coolant passages 67. The fourth coolant cavity 62 in each of the one or more cylinder heads 32 is below the third coolant cavity 60 and adjacent the bottom end 35 of each of the cylinder heads 32. The fourth coolant cavity 62 in each of the one or more cylinder heads 32 is configured to cool the cylinder head components.

The engine 10 includes a fifth coolant cavity 64, referred to as the cylinder liner coolant jacket, that is located in the engine block 12 surrounding the cylinder liners 14. The third coolant cavity 60 and the fourth coolant cavity 62 may be configured in any suitable manner, such as a variety of shapes, sizes, and locations in the one or more cylinder heads 32. The fifth coolant cavity 64 is adjacent and below the deck 30 of the engine block 12 and extends in between the cylinder liners 14 such the cylinders 16 are cooled by the coolant passing through the fifth coolant cavity 64 and contacting with the cylinder liners 14.

The engine 10 includes one or more fourth coolant passages 66 extending from the fourth coolant cavity 62 in each of the one or more cylinder heads 32 to the fifth coolant cavity 64. The one or more fourth coolant passages 66 are downward coolant flow passages since the one or more fourth coolant passages 66 are configured to allow coolant to flow downward from the fourth coolant cavity 62 to the fifth coolant cavity 64. Thus, each of the one or more fourth coolant passages 66 includes a first portion (not shown) of the coolant passage in the engine block 12 and a second portion (not shown) of the coolant passage in one of the one or more cylinder heads 32. The first portion and the second portion of each of the fourth coolant passages 66 are aligned to allow flow from the first portion into the second portion when each of the cylinder heads 32 are assembled to the engine block 12.

In FIG. 1, for simplicity, a single fourth coolant passage 66 is illustrated. In some embodiments, however, a fourth coolant passage 66 is associated with each of the cylinders 16 (i.e., one coolant passage per cylinder). Thus, as shown in FIG. 6, for example, for an engine 10 having six cylinders 16, there are six of the fourth coolant passages 66, one per cylinder, for directing coolant from the fourth coolant cavity 62 to the fifth coolant cavity 64. As shown in FIGS. 4 and 6, in the illustrated embodiment, one of the plurality of fourth coolant passages 66 extends through the deck 30 at a location adjacent each of the cylinders 16 and near the second side 24 of the engine block 12, such that the plurality of fourth coolant passages 66 are evenly spaced along a length of the engine block 12 and aligned with each cylinder 16. In other embodiments, however, the number of fourth coolant passages 66 may be greater than or less than the number of cylinder 16.

The engine 10 includes a sixth coolant cavity 68, referred to as an outlet rail, laterally adjacent to and in fluid communication with the fifth coolant cavity 64 via one or more fifth coolant passages (not shown). The sixth coolant cavity 68 extends along the first side 22 of the engine block 12 above the second coolant cavity 50. The sixth coolant cavity 68 is in fluid communication with a coolant outlet 70 where coolant exits the engine block 12.

The second coolant cavity 50 and the sixth coolant cavity 68 are large relative to the third, the fourth, and the fifth coolant cavities 60, 62, 64. The larger size of second coolant cavity 50 and the sixth coolant cavity 68 help coolant to be evenly distributed throughout the engine 10, especially within the fifth coolant cavity 64.

INDUSTRIAL APPLICABILITY

Internal combustion engines 10 with the coolant flow path and internal coolant passages of the present disclosure, can be used in a variety of applications, such as for example, to provide power to an off-highway truck, a railway locomotive, an earth-moving machine, an engine-driven generator or pumping system, or other engine-powered applications. The exemplary embodiments of the engine 10 include a top-down coolant flow from the one or more cylinder heads 32 into the cylinder liner coolant jacket. The top down coolant flow and the arrangement of the coolant flow paths provide for more effective and even cooling of the cylinder liners 14 and the cylinder heads 32.

In particular, coolant enters the first coolant cavity 46 and flows longitudinally (i.e., horizontally in FIG. 1) along a length of the engine block 12. The coolant then flows upward (i.e., vertically in FIG. 1) into the second coolant cavity 50 which extends along the length of the engine block 12. Coolant will pool in the second coolant cavity 50 due to the large size of the second coolant cavity 50 relative to the plurality of second coolant passages 56

Coolant from the second coolant cavity 50 then flows into the third coolant cavity 60 in the one or more cylinder heads 32 via the plurality of second coolant passages 56 while bypassing the fifth coolant cavity 64 (i.e., the cylinder liner coolant jacket). In the exemplary embodiment, since there is a second coolant passage 56 adjacent and associated with each of the cylinders 16 and a pool of coolant feeding the second coolant passages 56, the coolant flow into the third coolant cavity 60 is evenly, or nearly evenly, distributed.

With the third coolant cavity 60 above the fourth coolant cavity and the fourth coolant cavity above the fifth coolant cavity 64, flow from the third coolant cavity to the fourth coolant cavity and from the fourth coolant cavity to the fifth coolant cavity is downward and assisted by gravity. The coolant from the fourth coolant cavity 62 flows downward into the fifth coolant cavity 64 via the plurality of fourth coolant passages 66. In the exemplary embodiment, since the second coolant cavity 50 and the sixth coolant cavity 68 are large relative to the third, fourth, and fifth coolant cavities 60, 62, 64, the coolant flow through the third, the fourth, and the fifth coolant cavities 60, 62, 64 is evenly, or nearly evenly, distributed.

Coolant flow into the fifth coolant cavity 64 is initially downward; thus, coolant starts at the hottest parts of cylinder liners 14, near the deck 30, and passes downward along the sides of the cylinder liners 14. Within the fifth coolant cavity 64, coolant will also flow laterally around and between each cylinder liner 14 from the second side 24 of the engine block 12 to the first side 22. Since, however, a separate fourth coolant passage 66 is associated with each cylinder liner 14, the cylinder liners 14 are cooled in parallel rather than sequentially. Thus, unlike the uneven sequential cooling of the cylinders in a conventional design where coolant flows longitudinally along the cylinders, in the engine 10 of the present disclosure, coolant flow through the fifth coolant cavity 64 and the subsequent cooling of the cylinders 16 is even.

While the present disclosure has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the present disclosure, in its broader aspects, is not limited to the specific details, the representative compositions or formulations, and illustrative examples shown and described. Accordingly, departures may be made from such details without departing from the spirit or scope of Applicant's general disclosure herein.

LIST OF ELEMENTS

| LIST OF ELEMENTS | |
|---|---|
| Element Number | Element Name |
| 10 | engine |
| 12 | engine block |
| 14 | cylinder liner |
| 16 | cylinder |
| 18 | first end |
| 20 | second end |
| 22 | first side |
| 24 | second side |
| 26 | lower portion |
| 28 | upper portion |
| 30 | deck |
| 31 | bolt holes |
| 32 | cylinder head |
| 33 | top end |
| 34 | ports |
| 35 | bottom end |
| 36 | valve |
| 40 | coolant pump |
| 42 | oil cooler |
| 44 | oil cooler cavity |
| 46 | first coolant cavity |
| 48 | crankcase |
| 50 | second coolant cavity |
| 52 | first wall |
| 54 | first coolant passages |
| 56 | second coolant passages |
| 60 | third coolant cavity |
| 62 | fourth coolant cavity |
| 63 | first portion |
| 64 | fifth coolant cavity |
| 65 | second portion |
| 66 | fourth coolant passages |
| 67 | third coolant passages |
| 68 | sixth coolant cavity |
| 70 | coolant outlet |

What is claimed is:

1. An internal combustion engine, comprising:

a plurality of cylinder liners defining a plurality of cylinders; and an engine block housing the plurality of cylinder liners, the engine block including:

an upper planar surface;

a cylinder liner coolant jacket below the upper planar surface and in fluid communication with the plurality of cylinder liners;

one or more cylinder heads attached to the upper planar surface of the engine block, each of the one or more cylinder heads including one or more cylinder head coolant jackets;

a coolant cavity in the engine block separated from and below the cylinder liner coolant jacket;

one or more downward coolant passages extending from the one or more cylinder head coolant jackets to the cylinder liner coolant jacket for delivering coolant from the one or more cylinder head coolant jackets to the cylinder liner coolant jacket; and one or more upward coolant passages extending from the coolant cavity to the one or more cylinder head coolant jackets while bypassing the cylinder liner coolant jacket for delivering coolant from the coolant cavity to the one or more cylinder head coolant jackets.

2. The internal combustion engine of claim 1, wherein the one or more downward coolant passages includes a plurality of downward coolant passages, and wherein a number of the plurality of cylinders in the engine is equal to a number of the plurality of downward coolant passages.

3. The internal combustion engine of claim 2, wherein a separate one of the plurality of downward coolant passages is adjacent each of the plurality of cylinders.

4. The internal combustion engine of claim 2, wherein the one or more upward coolant passages includes a plurality of upward coolant passages, and wherein a number of the plurality of cylinders in the engine is equal to the number of the plurality of upward coolant passages.

5. The internal combustion engine of claim 4, wherein the engine block has a first side and a second side, and wherein the plurality of upward coolant passages are adjacent the first side and the plurality of downward coolant passages are adjacent the second side.

6. The internal combustion engine of claim 1, wherein the one or more cylinder head coolant jackets includes an upper coolant jacket and a lower coolant jacket below the upper coolant jacket, and wherein the one or more upward coolant passages extend into the upper coolant jacket.

7. The internal combustion engine of claim 1, wherein the coolant cavity extends below each of the plurality of cylinder liners.

8. The internal combustion engine of claim 1, further comprising a coolant pump and a second coolant cavity in the engine block below the coolant cavity, wherein the second coolant cavity is configured to receive coolant from the coolant pump and the coolant cavity in the engine block is configured to receive coolant from the second coolant cavity.

9. The internal combustion engine of claim 1, wherein the one or more cylinder head coolant jackets includes an upper coolant jacket and a lower coolant jacket below the upper coolant jacket, and wherein the one or more downward coolant passages extend from the lower coolant jacket.

10. A method of cooling an internal combustion engine having one or more cylinder heads attached to an upper planar surface of an engine block, the engine block housing a plurality of cylinder liners, the method comprising:

pumping coolant into the one or more cylinder heads, wherein pumping coolant into the one or more cylinder heads includes:

pumping coolant into the engine block below the plurality of cylinder liners; and directing coolant upward from below the plurality of cylinder liners to the one or more cylinder heads while bypassing cooling the plurality of cylinder liners; and directing coolant downward from the one or more cylinder heads into the engine block adjacent the plurality of cylinder liners to cool the plurality of cylinder liners.

11. The method of claim 10, wherein directing coolant upward from below the plurality of cylinder liners to the one or more cylinder heads further includes directing a plurality of coolant streams upward, wherein a number of the plurality of coolant streams upward equals a number of the plurality of cylinder liners.

12. The method of claim 10, wherein the engine block has a first side and a second side opposite the first side, and wherein directing coolant upward further includes directing coolant upward adjacent the first side and directing coolant downward further includes directing coolant downward adjacent the second side.

13. The method of claim 10, wherein pumping coolant into the one or more cylinder heads further includes pumping coolant into an upper jacket of the one or more cylinder heads and directing coolant from the upper jacket downward to a lower jacket of the one or more cylinder heads.

14. The method of claim 10, wherein directing coolant downward from the one or more cylinder heads into the engine block further includes directing a plurality of coolant streams downward, wherein a number of the plurality of coolant streams downward equals a number of the plurality of cylinder liners.

15. The method of claim 10, wherein pumping coolant into the engine block below the plurality of cylinder liners further includes pumping coolant into a lower cavity in the engine block and directing coolant from the lower cavity to an upper cavity in the engine block.

16. An engine block, comprising:

an upper planar surface;

a plurality of in-line cylinders extending downward from the upper planar surface into the engine block;

a cylinder coolant jacket below the upper planar surface and surrounding the plurality of in-line cylinders;

one or more cylinder heads attached to the upper planar surface of the engine block, each of the one or more cylinder heads including one or more cylinder head coolant jackets;

a coolant cavity separated from and below the cylinder coolant jacket;

a plurality of upward coolant passages extending from the coolant cavity through the upper planar surface, to the one or more cylinder head coolant jackets, and bypassing the cylinder coolant jacket; and a plurality of downward coolant passages extending from the one or more cylinder head coolant jackets into the cylinder coolant jacket to supply coolant to the cylinder coolant jacket.

17. The engine block of claim 16, further comprising a first side and a second side opposite the first side, wherein the plurality of upward coolant passages are adjacent the first side and the plurality of downward coolant passages are adjacent the second side.

18. The engine block of claim 16, wherein a number of the plurality of in-line cylinders in the engine block is equal to a number of the plurality of downward coolant passages, and wherein a separate one of the plurality of downward coolant passages is adjacent each of the plurality of in-line cylinders.

19. The engine block of claim 16, wherein a number of the plurality of in-line cylinders in the engine block is equal to a number of the plurality of upward coolant passages, wherein the engine block has a first side and a second side, and wherein the plurality of upward coolant passages are adjacent the first side and the plurality of downward coolant passages are adjacent the second side.

20. The engine block of claim 16, wherein the cylinder coolant jacket includes an upper coolant jacket and a lower coolant jacket below the upper coolant jacket, and wherein the plurality of upward coolant passages extend into the upper coolant jacket.

* * * * *